US011382820B2

(12) United States Patent
English et al.

(10) Patent No.: US 11,382,820 B2
(45) Date of Patent: Jul. 12, 2022

(54) STAIR ASSIST CANE

(71) Applicants: William Hood English, Castle Rock, CO (US); Norman Earl Smith, II, Castle Rock, CO (US)

(72) Inventors: William Hood English, Castle Rock, CO (US); Norman Earl Smith, II, Castle Rock, CO (US)

( * ) Notice: Subject to any disclaimer, the term of this patent is extended or adjusted under 35 U.S.C. 154(b) by 55 days.

(21) Appl. No.: 17/085,698

(22) Filed: Oct. 30, 2020

(65) Prior Publication Data

US 2021/0244600 A1 Aug. 12, 2021

Related U.S. Application Data

(60) Provisional application No. 62/975,110, filed on Feb. 11, 2020.

(51) Int. Cl.
*A61H 3/00* (2006.01)

(52) U.S. Cl.
CPC ..... *A61H 3/00* (2013.01); *A61H 2003/001* (2013.01); *A61H 2201/0157* (2013.01); *A61H 2201/0192* (2013.01)

(58) Field of Classification Search
CPC ..... A61H 2003/001
See application file for complete search history.

(56) References Cited

U.S. PATENT DOCUMENTS 1,089,295 A 3/1914 Vallier
1,277,009 A 8/1918 Weldon
2,413,202 A 12/1946 Vrooman et al.
2,656,874 A 10/1953 Robb
2,817,387 A 12/1957 Blake
2,855,024 A 10/1958 Robb
3,199,521 A 8/1965 Ries
3,280,831 A 10/1966 Parker
3,289,685 A 12/1966 Parker
3,387,618 A * 6/1968 Swann ..... A61H 3/02 135/67
3,800,815 A 4/1974 Birk
4,094,331 A 6/1978 Rozsa
4,106,521 A 8/1978 Thomas
4,777,973 A 10/1988 Nakajima
4,993,446 A 2/1991 Yarbrough
5,402,587 A 4/1995 Bushbacher
5,649,558 A 6/1997 Richard
(Continued)

FOREIGN PATENT DOCUMENTS

HU PCT/HU99/00043 A1 12/1999

*Primary Examiner* — Noah Chandler Hawk
(74) *Attorney, Agent, or Firm* — Williams Intellectual Property; Timothy Snyder

(57) ABSTRACT

A stair assist cane generally includes a handle, a first leg, a second leg, a first pair of feet, and a second pair of feet. The handle, first leg, and second leg are assembled to form a vertical plane when the cane is in use. The first pair of feet are disposed at a bottom end of the first leg and the second pair of feet are disposed at a bottom end of the second leg. The feet in the first pair of feet and second pair of feet laterally extend from the vertical plane in opposing directions to provide lateral support. The bottom end of the first leg is vertically offset in position relative to the bottom end of the second leg to permit the user to place each pair of feet on different stair steps to assist the user in ascending and descending stair steps.

20 Claims, 7 Drawing Sheets

(56) References Cited

U.S. PATENT DOCUMENTS

| | | | | |
|---|---|---|---|---|
| 5,647,602 | A | 7/1997 | Nevin | |
| 5,673,719 | A | 10/1997 | Shofner | |
| 5,740,825 | A | 4/1998 | Brunengo | |
| 5,785,070 | A | 6/1998 | Block et al. | |
| 5,787,913 | A | 8/1998 | Li | |
| 5,957,146 | A * | 9/1999 | Corey | A61H 3/00 52/645 |
| 6,164,305 | A | 12/2000 | Herman | |
| 6,206,019 | B1 | 3/2001 | Horvitz | |
| 6,705,336 | B2 | 3/2004 | Goligorski | |
| 6,755,203 | B1 | 6/2004 | Roeglin | |
| 7,261,114 | B2 * | 8/2007 | Karasin | A61H 3/04 135/85 |
| 7,673,641 | B2 * | 3/2010 | Karasin | A61H 3/00 135/85 |
| 8,667,976 | B2 | 3/2014 | Huang | |
| 8,919,362 | B1 | 12/2014 | Mortenson | |
| 9,119,757 | B2 | 9/2015 | Triolo et al. | |
| 9,375,378 | B2 | 6/2016 | Price | |
| 9,895,281 | B1 * | 2/2018 | Sigsworth | A61H 3/00 |
| 9,936,777 | B1 | 4/2018 | Parkinson et al. | |
| 2008/0029138 | A1 | 2/2008 | Foote | |
| 2012/0298160 | A1 | 11/2012 | Hamilton | |
| 2013/0319488 | A1 * | 12/2013 | Chiu | A61H 3/00 135/69 |
| 2014/0261587 | A1 | 9/2014 | Price | |
| 2018/0021200 | A1 * | 1/2018 | Orndorff | A61H 1/00 135/67 |

* cited by examiner

STAIR ASSIST CANE

CROSS-REFERENCE TO RELATED APPLICATIONS

The present application claims priority benefit to U.S. Provisional Application Ser. No. 62/975,110 filed Feb. 11, 2020; the contents of which are hereby incorporated.

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of walking canes are known in the prior art. These canes are generally configured for use on a flat surface and do not provide much support for ascending and descending stairs. Conventional canes further lack the ability to laterally support the user. This is particularly problematic for seniors, and arthritic or injured individuals who rely on a cane for mobility.

Thus there exists a need in the art for a stair assist cane to assist a user in ascending and descending stairs. There is a further need to provide lateral support to the user while doing the same.

FIELD OF THE INVENTION

The present invention generally relates to walking canes, and more particularly to a stair assist cane to assist a user in ascending and descending stairs.

SUMMARY OF THE INVENTION

The general purpose of the stair assist cane, described subsequently in greater detail, is to provide a stair assist cane which has many novel features that result in a stair assist cane which is not anticipated, rendered obvious, suggested, or even implied by prior art, either alone or in combination thereof.

A stair assist cane is described herein. The stair assist cane includes a handle, a first leg, a second leg, a first ground contacting member, and a second ground contacting member. The first leg is connected to a first end of the handle, and the second leg is connected to an opposing end of the handle. The first ground contacting member is disposed at a bottom end of the first leg, and the second ground contacting member is disposed at a bottom end of the second leg. The handle, the first leg, and the second leg form a vertical plane when the cane is in use. A bottom end of the first leg is vertically offset in position from a bottom end of the second leg to permit a user to place each ground contacting member on different stair steps to assist the user with ascending and descending stairs.

Thus has been broadly outlined the more important features of the present stair assist cane so that the detailed description thereof that follows may be better understood and in order that the present contribution to the art may be better appreciated.

Objects of the present stair assist cane, along with various novel features that characterize the invention are particularly pointed out in the claims forming a part of this disclosure. For better understanding of the stair assist cane, its operating advantages and specific objects attained by its uses, refer to the accompanying drawings and description.

BRIEF DESCRIPTION OF THE DRAWINGS

Figures

DETAILED DESCRIPTION OF THE DRAWINGS

The present invention has utility as a stair assist cane to assist a user in ascending and descending stairs. The stair assist cane may further provide lateral support to the user while ascending and descending stairs. The stair assist cane is advantageously used on a lateral side of a user, which permits the user to use the cane in several circumstances or situations that would otherwise be cumbersome with 4-legged front/side walkers. These circumstances or situations may include narrow stair corridors, the ability to have one hand free to use a handrail, as well as cost and manufacturing advantages. The following description of various embodiments of the invention is not intended to limit the invention to those specific embodiments, but rather to enable any person skilled in the art to make and use this invention through exemplary aspects thereof.

With reference now to the drawings, and in particular FIGS. 1 through 9 thereof, examples of the instant stair assist cane employing the principles and concepts of the present stair assist cane and generally designated by the reference number 10 will be described.

Figure 1:
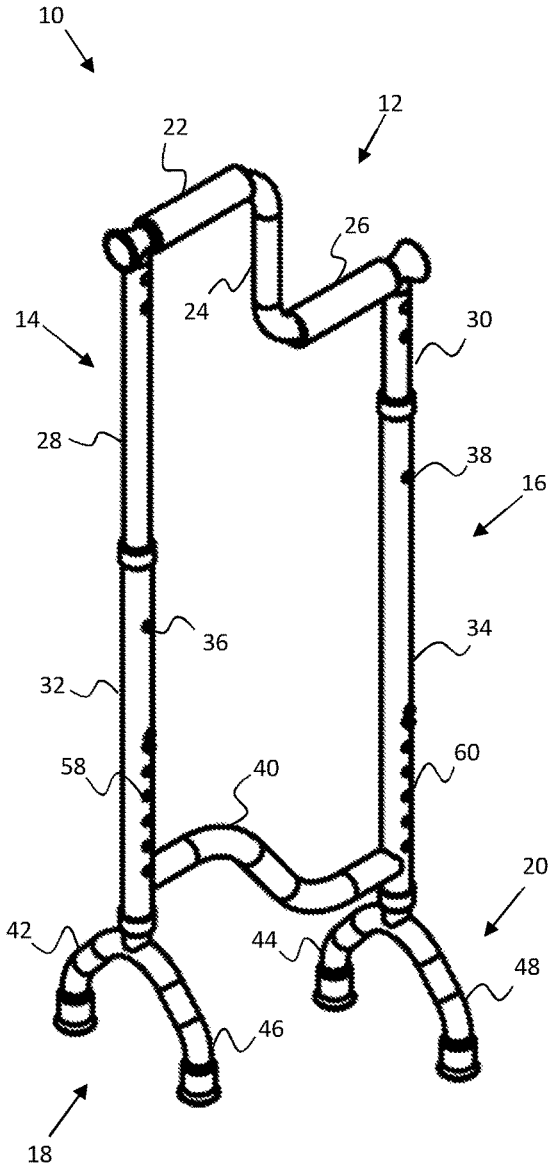
FIG. 1 is a first perspective view of a stair assist cane.
Figure 2:
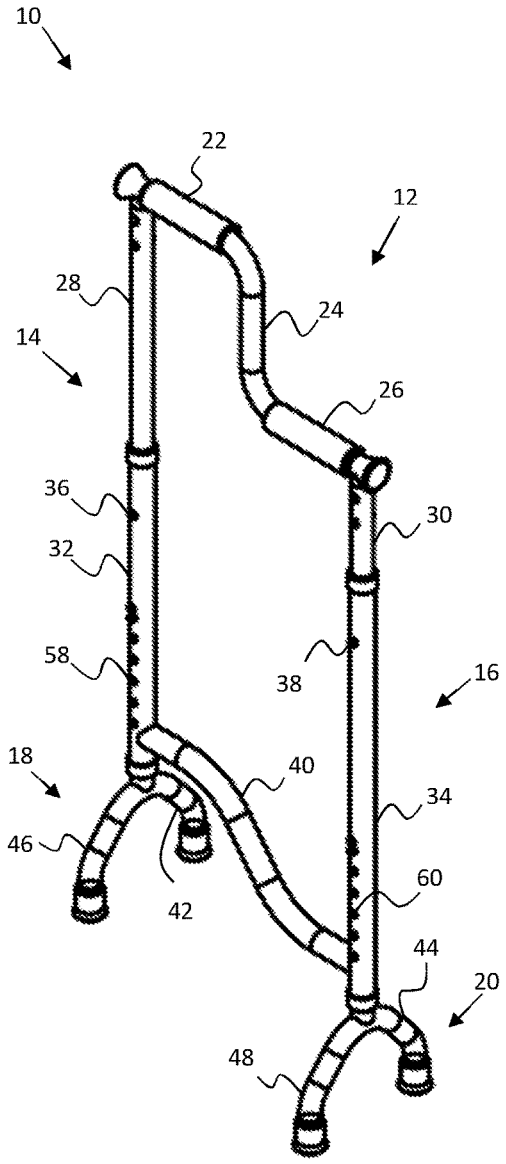
FIG. 2 is a second perspective view of a stair assist cane.
Figure 3:
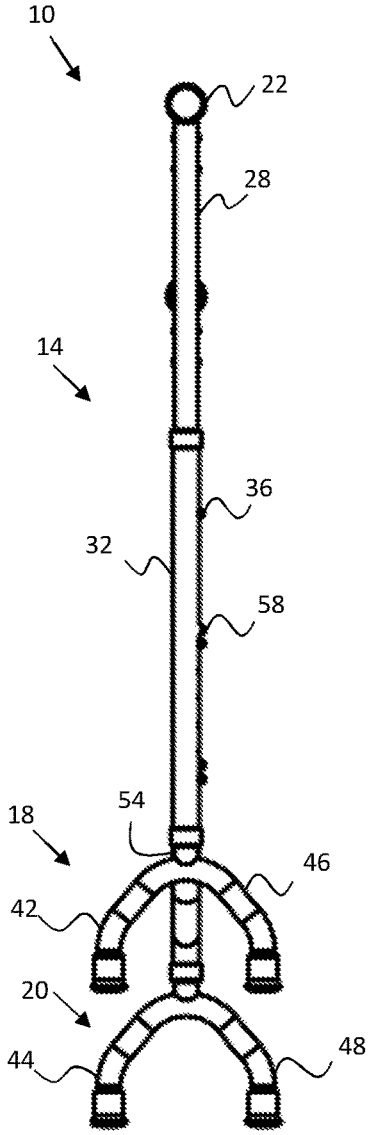
FIG. 3 is a front view of a stair assist cane.
Figure 4:
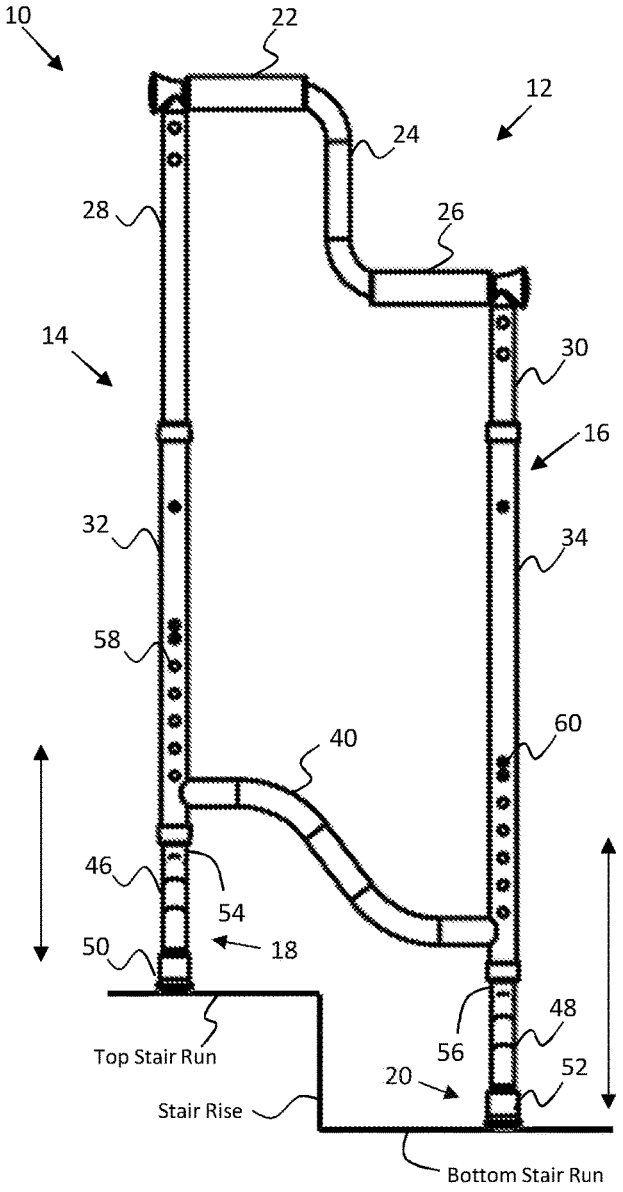
FIG. 4 is a side view of a stair assist cane.
Figure 5:
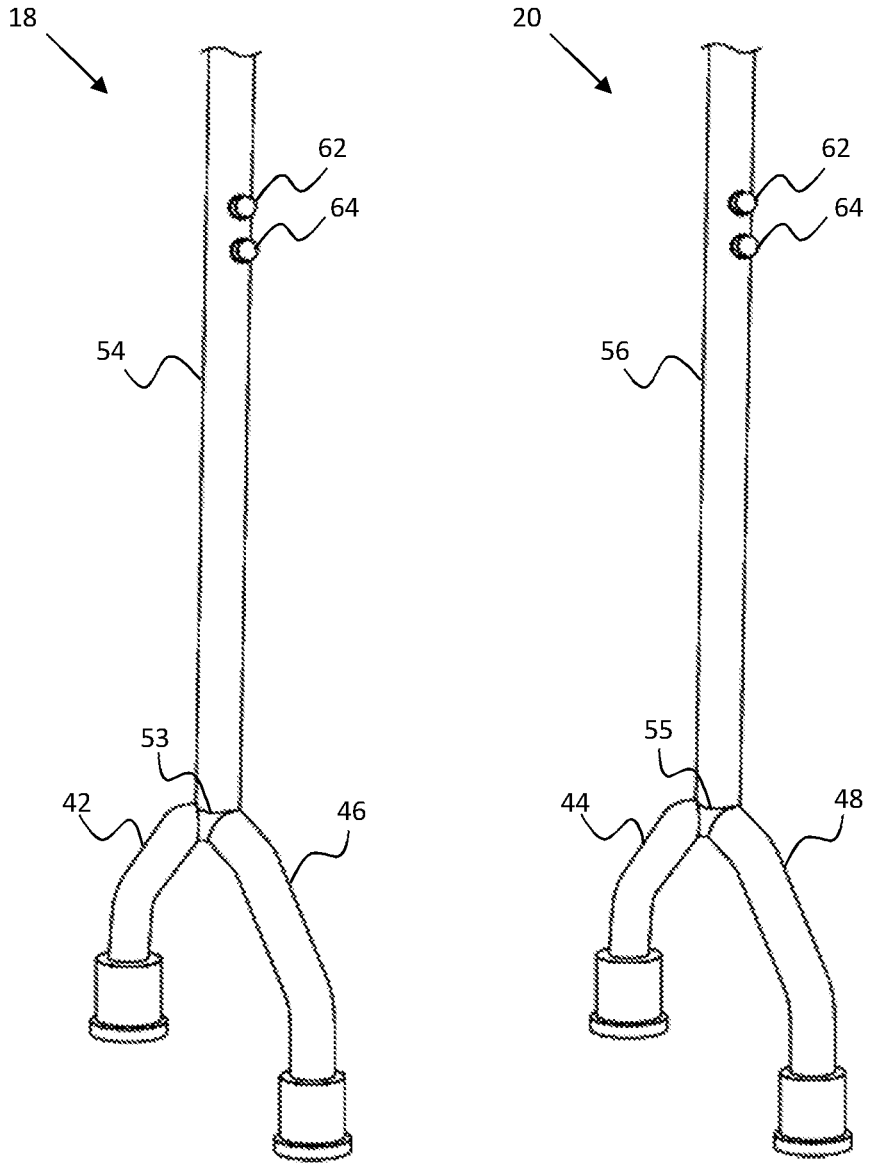
FIG. 5 is a detailed view of two pairs of feet of a stair assist cane.
Figure 6:
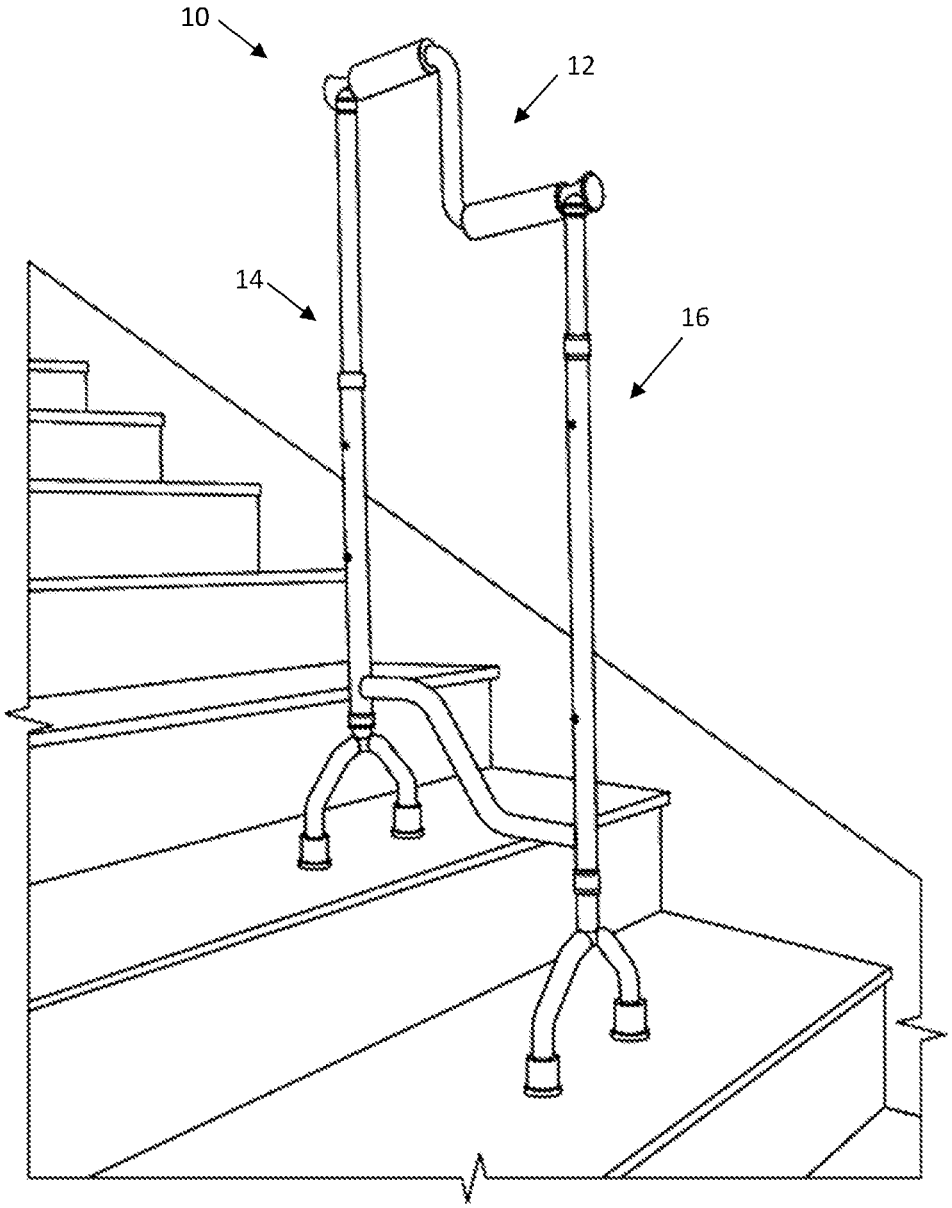
FIG. 6 depicts a stair assist cane resting on a pair of stair steps.

Referring now to FIGS. 1 through 6, a particular embodiment of the present stair assist cane 10 and/or its components are illustrated. The stair assist cane 10 generally includes a handle 12, a first leg 14, a second leg 16, a first pair of feet 18, and a second pair of feet 20. A top end of the first leg 14 is connected to a first end of the handle 12, and a top end of the second leg 16 is connect to an opposing end of the handle 12. A vertical plane is formed by the handle 12, the first leg 14, and the second leg 16 when the cane 10 is in use (referred to hereinafter as the 'frame vertical plane'). The first pair of feet 18 are disposed at a bottom end of the first leg 14, and the second pair of feet 20 are disposed at a bottom end of the second leg 16. The bottom end of the first leg 14 is vertically offset from the bottom end of the second leg 16 to permit the user to place the first pair of feet 18 and second pair of feet 20 on different stair steps as best seen in FIGS. 4 and 6. This assists the user in ascending and descending stairs. This configuration may further maintain at least a portion of the handle 12 in a horizontal position for the user to easily grasp and provide a supporting structure for leverage or support. When the stair assist cane 10 is in use, the first pair of feet 18 and the second pair of feet 20 may laterally extend in opposing directions from the vertical plane formed by the handle 12, first leg 14, and second leg 16, to provide lateral support to the user while ascending and descending stairs. However, it will be appreciated that other types or shapes of feet (18, 20) may be used as described below.

The handle 12 may include a first horizontal portion 22, a middle portion 24, and a second horizontal portion 26, where the first horizontal portion 22 and the second horizontal portion 26 are offset in position by the length or slope of the middle portion 24. In more detail, the first horizontal portion 22 may have a first end connected to the top end of the first leg 14 and an opposing end connected to a first end of the middle portion 24. The second horizontal portion 26 may have a first end connected to the top end of the second leg 16 and an opposing end connected to an opposing end of the middle portion 24. The middle portion 24 may be substantially vertical relative to the horizontal portions (22, 26) (i.e., substantially being within a few degrees in perpendicularity to the horizontal portions (22, 26). Alternatively, the middle portion 24 may be sloped from the first horizontal portion 22 to the second horizontal portion 26. The handle 12 may also or alternatively be described as being in the shape of a "Z", where the middle portion of the handle 12 may be sloped anywhere from 20 degrees to 160 degrees relative to the horizontal portions (22, 26). Further, the first horizontal portion 22 and second horizontal portion 26 may be substantially parallel relative to one another to form two horizontally parallel surfaces to rest the user's hand. However, the horizontal portions do not necessarily have to be parallel. These configurations of the handle 12 is particularly advantageous as a user may use the first horizontal portion 22 for support while descending stairs, and the second horizontal portion 26 for support while ascending stairs. For this reason, it may be further beneficial to have the middle portion 24 of the handle 12 be substantially perpendicular relative to the horizontal portion (22, 26) to optimize the overall lengths of the horizontal portions (22, 26) for use while ascending or descending stairs. The handle 12 may further include a grippable material, for example, rubber or foam surrounding at least a portion of the horizontal portions (22, 26) to improve the grip of the user on the cane 10.

The first leg 14 and the second leg 16 may come in many different forms. For example, the first leg 14 and second leg 16 may be one or more shafts, one or more poles, one or more tubes, one or more bars, one or more rods, or combinations thereof. In particular embodiments, the first leg 14 and second leg 16 each include an inner top tube (28, 30) and an outer bottom tube (32, 34). The inner top tubes (28, 30) may fit inside the outer bottom tubes (32, 34), where the inner top tubes (28, 30) are slidable relative to the outer bottom tubes (32, 34). The inner top tubes (28, 30) may be fixed into position relative to the outer bottom tubes (32, 34) via one or more ball-detent mechanisms (36, 38). This may permit the user to adjust the height of the handle 12 relative to the feet (18, 20), and also permit the user to remove the handle 12 from the rest of the cane 10 for storage or transportation if needed. It should be appreciated, that the position of the inner top tubes (28, 30) and the outer bottom tubes (32, 34) may be swapped where the outer tubes are on the top and the inner tubes are on the bottom.

When the cane is in use, the bottom end of the first leg terminates in a vertically offset position from that of where the bottom end of the second leg terminates to permit the user to place each pair of feet on different stair steps to assist the user in ascending or descending stairs. In particular embodiments, the bottom end of the first leg 14 terminates higher than that of where the bottom end of the second leg terminates. The horizontal portions (22, 26) of the handle 12 may advantageously remain substantially parallel to the stair step runs while the cane is being used on two sequential stair steps. The bottom ends of the first leg 14 and second leg 16 may terminate at different vertical positions by way of having the first leg 14 be a different length than the second leg 16. For example, the overall length of the first leg 14 may be less than that of the overall length of the second leg 16. In another embodiment, the first leg 14 and second leg 16 are of the same length, where the offset in their vertical positions is achieved by the horizontal portions (22, 26) of the handle 12 being offset by the length or slope of the middle portion 24 of the handle 12.

To provide additional stability to the stair assist cane 10, the cane 10 may further include a cross supporting member 40 traversing from a bottom portion of the first leg 14 to a bottom portion of the second leg 16. The cross supporting member 40 may come in many different forms. For example, the cross supporting member 40 may be one or more rods, one or more poles, one or more bars, one or more tubes, or combinations thereof. In a particular embodiment, the cross supporting member 40 is a tube having a first horizontal portion, a middle portion, and a second horizontal portion, where the first horizontal portion and the second horizontal portion are offset in position by the length or slope of the middle portion. This particular configuration of the cross supporting member 40 may be necessary because the bottom end of the first leg 14 is vertically offset from the bottom end of the second leg 16. The cross-supporting member 40 may also be described as being the shape of a "Z", where the middle portion of the cross supporting member 40 may be sloped anywhere from 20 degrees to 160 degrees relative to the horizontal portions of the cross supporting member 40.

The feet of the stair assist cane 10 that make contact with the ground may come in various shapes or sizes, and are generically referred to herein as ground contacting members. For example, each leg (14, 16) may simply terminate at a sole that makes contact with the ground (e.g., a foot that is a single post or peg). In another example, each pair of feet (18, 20) may be shaped like an upside down "T", which may provide lateral support to the user if each foot in each pair of feet (18, 20) extend laterally in opposing directions from one another.

In particular embodiments, each pair of feet (18, 20) may generally include a first foot (42, 44) and a second a foot (46, 48), where the first foot (42, 44) extends in a first lateral direction from the frame vertical plane (or away from the user), and the second foot (46, 48) extends in an opposing lateral direction from the frame vertical plane (or towards the user). In particular embodiments, the feet in the first pair of feet 18 and the second pair of feet 20 extend in opposing directions and in a vertical perpendicular plane relative to the frame vertical plane such that the first pair of feet 18 and second pair of feet 20 are substantially parallel to the stair step risers when the cane 10 is in use (as best seen in FIG. 4). The first foot (42, 44) and second foot (46, 48) may have top ends that connect or join at an apex (53, 55) (as shown in FIG. 5), where the first foot (42, 44) and second foot (46, 48) arc and/or extend in a down and away manner from the apex 53 and terminate at a sole which makes contact with the ground. The soles (representatively shown in FIG. 4 as 50 and 52) of each foot (42, 44, 46, and 48) may be capped with a polymeric (e.g., rubber) material to provide a grip on the ground surface and/or to protect the ground surfaces on which the cane 10 is used.

Each pair of feet (18, 20) may further include a vertical adjustment member (54, 56) in the form of at least one of a shaft, tube, pole, or bar extending vertically upwards from the apex 53 as best seen in FIG. 5. In particular embodiments, the vertical adjustment members (54, 56) are in the form of a tube that fit inside the outer bottom tubes (32, 34) of their respective legs (14, 16) such that the vertical adjustment members (54, 56) can slide therein. This permits the user to adjust the height of each pair of feet (18, 20) relative to the handle 12. The height of each pair of feet (18, 20) may be adjusted and fixed in place using ball detent mechanisms. For example, the outer bottom tubes (32, 34) may include a series of detents (58, 60), that can receive one or more balls (62, 64) positioned on the vertical adjustment members (54, 56) (the one or more balls (62, 64) on the vertical adjustment members (54, 56) are shown in FIG. 5). In a specific embodiment, the vertical adjustment members (54, 56) includes two balls (62, 64) where the spacing between the balls (62, 64) are half that of the spacing between the detents (58, 60). This increases the resolution in which the height of each pair of feet (18, 20) can be adjusted. In addition, the top two detents (58, 60) on the outer bottom tubes (32, 34) may have the same spacing as the two balls (62, 64) on the vertical adjustment member (54, 56) to further secure the position of each pair of feet (18, 20) in their highest vertical position.

Figure 7:
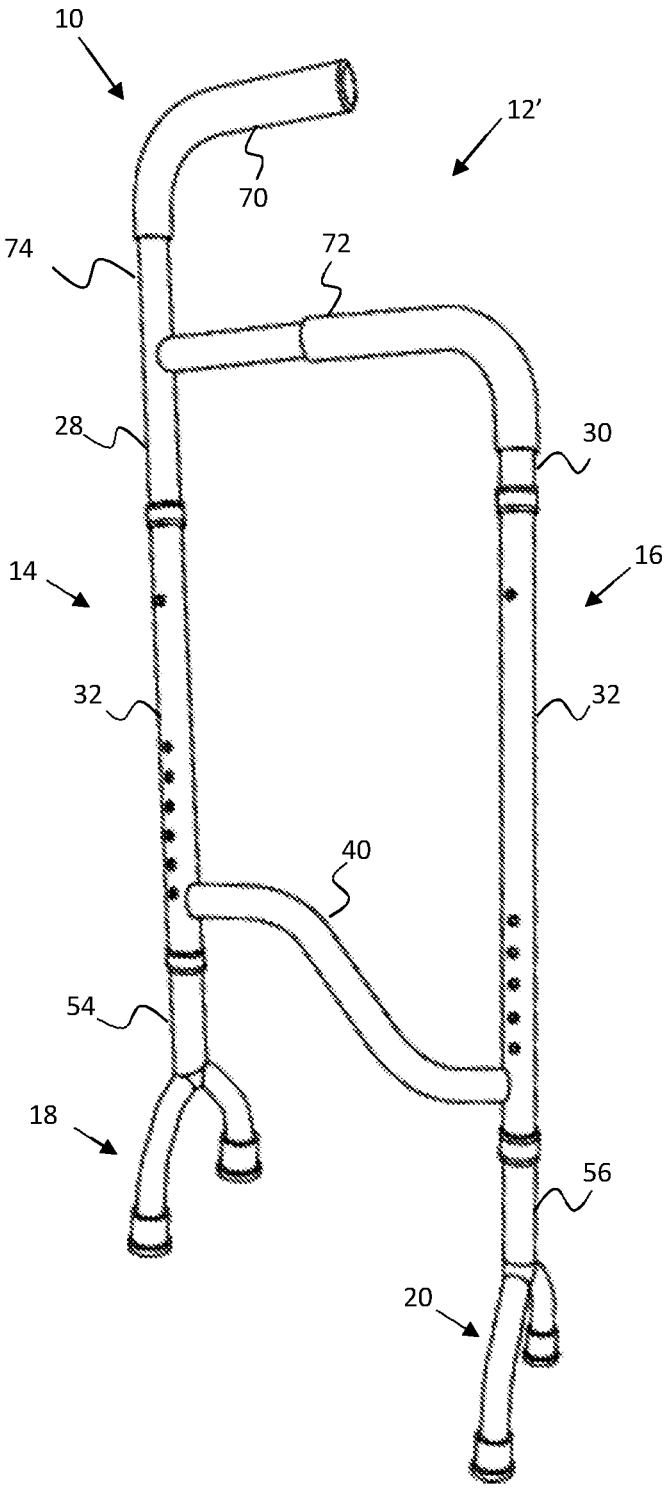
FIG. 7 depicts a side view of a stair assist cane having an alternative handle.

With reference now to FIG. 7, the stair assist cane 10 may include a different configuration of a handle 12'. The handle 12' may include a first horizontal handle 70, a second horizontal handle 72, and a vertical portion 74, where the first horizontal handle 70 is vertically offset in position be the length or slope of the vertical portion 74. In one embodiment, the first horizontal handle 70 has a first end connected to a first end of the vertical portion 74 and extends from the connection in a horizontal direction towards the cane 10. The second horizontal handle 72 has a first end connected to an opposing end of the vertical portion 74 and an opposing end connected to the top end of the second leg 16. In another embodiment, the vertical portion 74 is an extension of the first leg 14, where a portion of the first leg extends vertically beyond the second handle 72. Here, a first end of the first horizontal handle 70 is connected to a top end of the first leg 14 and extends from the connection in a horizontal direction towards the cane 10. A first end of the second horizontal handle 72 connects at a location along the length of the first leg 14 that is below the first horizontal handle 70, where an opposing end of the second horizontal handle 72 connects to a top end of the second leg 16. The configuration of the handle 12' is likewise advantageous because a user can use the first horizontal handle 70 for support while descending stairs and the second horizontal handle 72 for support while ascending stairs. The handle 12' may further include a grippable material, for example, rubber or foam surrounding at least a portion of the horizontal handles (70, 72) to improve the grip of the user on the cane 10. The grippable material may further extend onto the vertical portion 74, first leg 14, or second leg 16.

Figure 8:
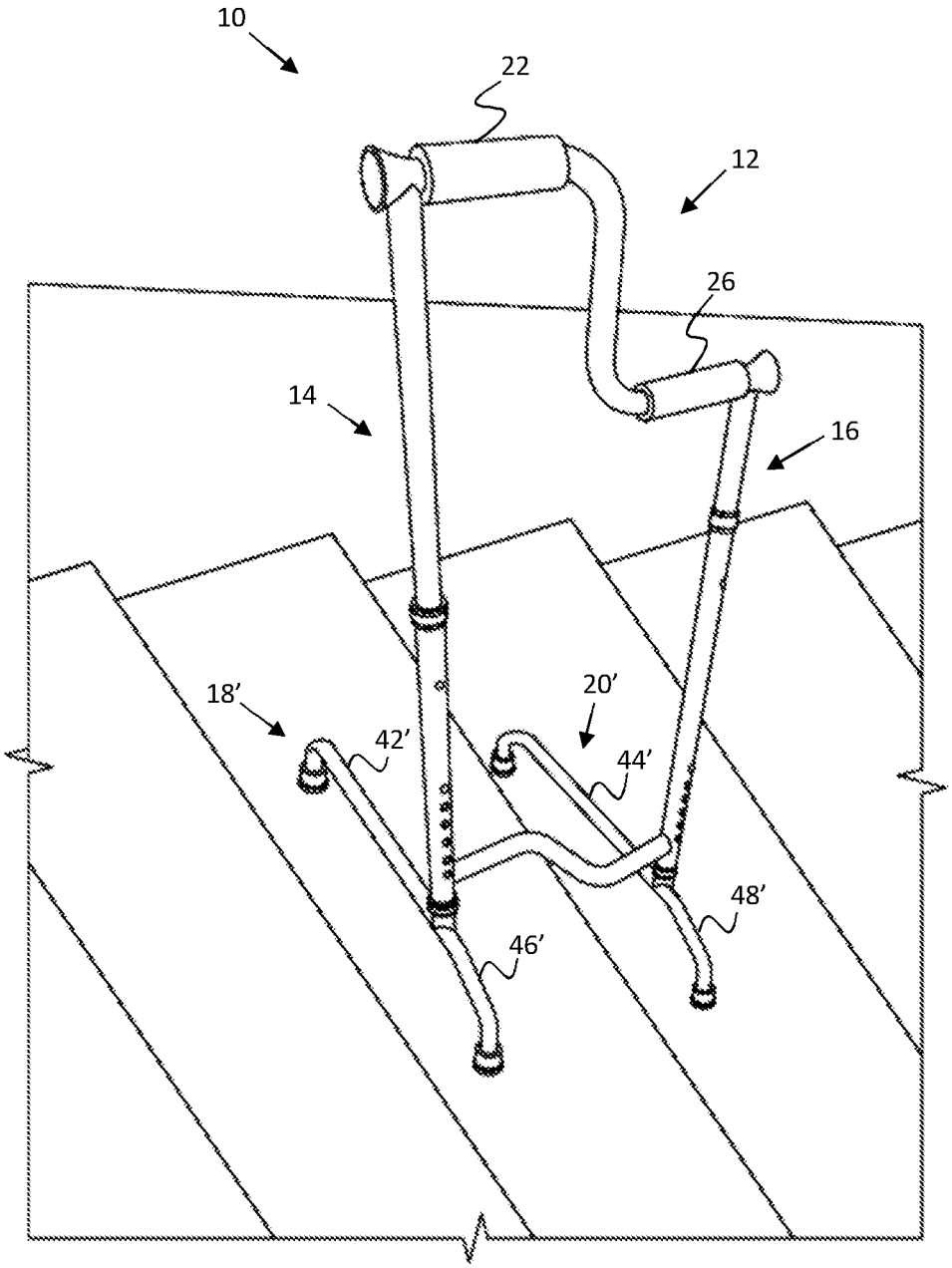
FIG. 8 is a perspective view of a stair assist cane having an alternative configuration of feet, where the stair assist cane is shown resting on a pair of stair steps.
Figure 9:
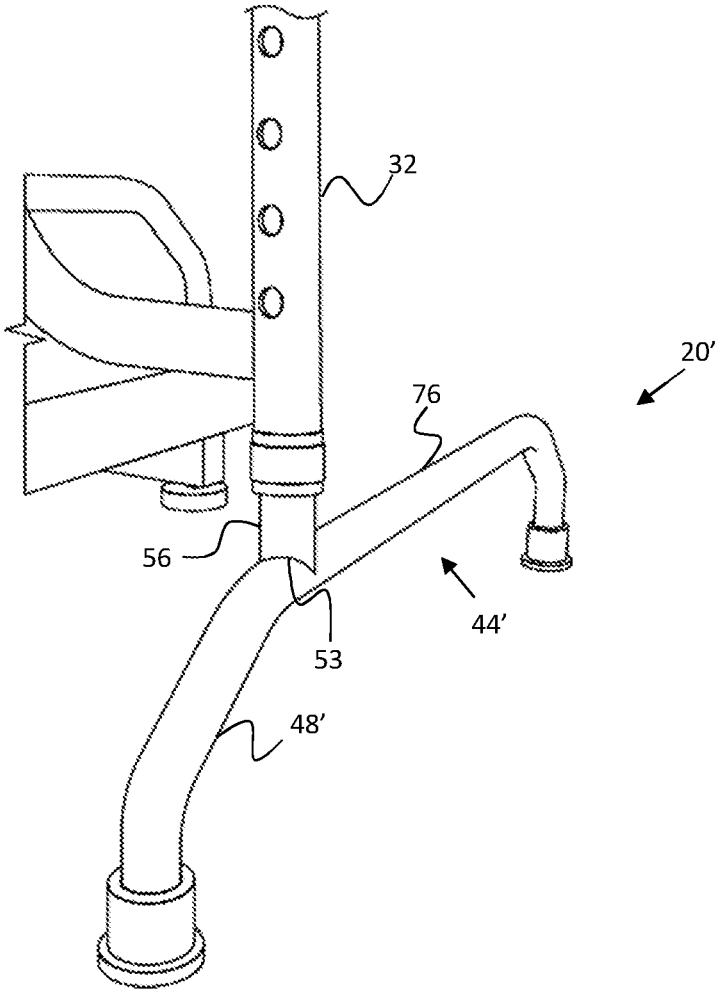
FIG. 9 is a perspective detailed view of one pair of an alternative configuration of feet.

With reference now to FIGS. 8 and 9, a stair assist cane 10 that provides additional lateral stability is shown. The first foot (42', 44') in each pair of feet (18', 20') projects farther in the lateral direction than the second foot (46', 48') in each pair of feet (18', 20'). In this configuration, the first foot (42', 44') is the foot that projects in a lateral direction away from the user, while the second foot (46', 48') projects in a lateral direction towards the user. The first foot (42', 44') may project farther than the second foot (46', 48') by way of the first foot (42', 44') having a horizontal portion 76 that extends laterally from the apex 53 before the foot (42', 44') arcs and/or extends in a down and away manner to terminate at a sole which makes contact with the ground. The horizontal portion 76 adds length to the first foot (42', 44') for the additional stability. In a specific embodiment, the first foot (42', 44') in each pair of feet (18', 20') is between 1.5× to 3× longer than the second foot (46', 48') in each pair of feet (18', 20'). It should be appreciated that the feet (18', 20') for added stability may be adapted or used on any of the aforementioned stair assist canes 10.

Other Embodiments

While at least one exemplary embodiment has been presented in the foregoing detail description, it should be appreciated that a vast number of variations exist. It should also be appreciated that the exemplary embodiment or exemplary embodiments are only examples, and are not intended to limit the scope, applicability, or configuration of the described embodiments in any way. It should be understood that various changes may be made in the function and arrangement of elements without departing from the scope as set forth in the appended claims and the legal equivalents thereof.

What is claimed is:

1. A stair assist cane, comprising a handle comprising a first horizontal portion, a middle portion, and a second horizontal portion, wherein the first horizontal portion and the second horizontal portion are vertically offset relative to one another by a length or slope of the middle portion, and wherein the middle portion is substantially vertical relative to the first horizontal portion and the second horizontal portion;

a first leg connected to a first end of the handle;

a second leg connected to an opposing end of the handle;

a first ground contacting member disposed at a bottom end of the first leg and a second ground contacting member disposed at a bottom end of the second leg;

wherein the handle, first leg, and second leg form a vertical plane when the cane is in use; and wherein a bottom end of the first leg is vertically offset in position from a bottom end of the second leg to permit a user to place each ground contacting member on different stair steps to assist the user in ascending or descending stair steps.

2. The stair assist cane of claim 1 wherein an overall length of the first leg is less than an overall length of the second leg to achieve the vertical offset in position between the bottom end of the first leg relative to the bottom end of the second leg.

3. The stair assist cane of claim 1 wherein the first horizontal portion, the middle portion, and the second horizontal portion are connected in series, with a top end of the first leg connected to the first horizontal portion, and a top end of the second leg connected to the second horizontal portion.

4. The stair assist cane of claim 1 wherein the first ground contacting member comprises a first pair of feet, and the second ground contacting member comprises a second pair of feet, wherein the feet in each pair of feet laterally extend in opposing directions from the vertical plane to provide lateral support to the user.

5. The stair assist cane of claim 4 wherein a first foot in each pair of feet projects farther in the lateral direction than a second foot in each pair of feet, wherein the first foot projects laterally away from a user when the cane is in use, and the second foot projects laterally toward the user when the cane is in use.

6. The stair assist cane of claim 1 wherein an overall length of the first leg is approximately the same as an overall length of the second leg, wherein the vertical offset between the bottom end of the first leg relative to the bottom end of the second leg is formed by the vertical offset between the first horizontal portion of the handle relative to the second horizontal portion of the handle.

7. The stair assist cane of claim 1 wherein each ground contacting member comprises a vertical adjustment member to permit a user to adjust a height of the handle relative to each ground contacting member.

8. The stair assist cane of claim 1 wherein the first leg and the second leg each comprise an inner top tube and an outer bottom tube, wherein the inner top tube is slidable relative to the outer bottom tube.

9. The stair assist cane claim 8 wherein each ground contacting member comprises a vertical adjustment member that is slidable within the outer tube of each leg to permit a user to adjust a height of the handle relative to each ground contacting member.

10. A stair assist cane, comprising:

a handle;

a first leg connected to a first end of the handle;

a second leg connected to an opposing end of the handle;

a first ground contacting member disposed at a bottom end of the first leg and a second ground contacting member disposed at a bottom end of the second leg;

a cross supporting member traversing from a bottom portion of the first leg to a bottom portion of the second leg, wherein the cross supporting member comprises a first horizontal portion, a middle portion, and a second horizontal portion, wherein the first horizontal portion and second horizontal portion are vertically offset relative to one another by a length or slope of the middle portion;

wherein the handle, first leg, and second leg form a vertical plane when the cane is in use; and wherein a bottom end of the first leg is vertically offset in position from a bottom end of the second leg to permit a user to place each ground contacting member on different stair steps to assist the user in ascending or descending stair steps.

11. The stair assist cane of claim 10 wherein the first ground contacting member comprises a first pair of feet, and the second ground contacting member comprises a second pair of feet, wherein the feet in each pair of feet laterally extend in opposing directions from the vertical plane to provide lateral support to the user.

12. The stair assist cane of claim 10 wherein an overall length of the first leg is less than an overall length of the second leg to achieve the vertical offset in position between the bottom end of the first leg relative to the bottom end of the second leg.

13. The stair assist cane of claim 10 wherein an overall length of the first leg is approximately the same as an overall length of the second leg, wherein the vertical offset between the bottom end of the first leg relative to the bottom end of the second leg is formed by the vertical offset between the first horizontal portion of the handle relative to the second horizontal portion of the handle.

14. The stair assist cane of claim 10 wherein each ground contacting member comprises a vertical adjustment member to permit a user to adjust a height of the handle relative to each ground contacting member.

15. The stair assist cane of claim 10 wherein the handle further comprises a first horizontal portion, a middle portion, and a second horizontal portion, wherein the first horizontal portion and the second horizontal portion are vertically offset relative to one another by a length or slope of the middle portion, wherein the middle portion is substantially vertical relative to the first horizontal portion and the second horizontal portion.

16. A stair assist cane, comprising:

a first leg;

a second leg;

a first horizontal handle having a first end connected to a top end of the first leg, wherein the first horizontal handle extends from the first leg in a horizontal direction towards the cane;

a second horizontal handle having a first end connected to the first leg at a point below the top end of the first leg such that the first horizontal handle is vertically offset from the second horizontal handle by a portion of the first leg, and wherein an opposing end of the second horizontal handle is connected to a top end of the second leg;

a first ground contacting member disposed at a bottom end of the first leg and a second ground contacting member disposed at a bottom end of the second leg;

wherein the handle, first leg, and second leg form a vertical plane when the cane is in use; and wherein a bottom end of the first leg is vertically offset in position from a bottom end of the second leg to permit a user to place each ground contacting member on different stair steps to assist the user in ascending or descending stair steps.

17. The stair assist cane of claim 16 wherein the first ground contacting member comprises a first pair of feet, and the second ground contacting member comprises a second pair of feet, wherein the feet in each pair of feet extend laterally in opposing directions from the vertical plane to provide lateral support to the user.

18. The stair assist cane of claim 16 wherein an overall length of the first leg is less than an overall length of the second leg to achieve the vertical offset in position between the bottom end of the first leg relative to the bottom end of the second leg.

19. The stair assist cane of claim 16 wherein an overall length of the first leg is approximately the same as an overall length of the second leg, wherein the vertical offset between the bottom end of the first leg relative to the bottom end of the second leg is formed by the vertical offset between the first horizontal portion of the handle relative to the second horizontal portion of the handle.

20. The stair assist cane of claim 16 wherein each ground contacting member comprises a vertical adjustment member to permit a user to adjust a height of the first horizontal handle and the second horizontal handle relative to each ground contacting member.

* * * * *